United States Patent [19]

Wildgoose et al.

[11] 4,013,424

[45] Mar. 22, 1977

[54] COMPOSITE ARTICLES

[75] Inventors: Paul Wildgoose; Raymond George Ubank, both of Bristol, England

[73] Assignee: Rolls-Royce (1971) Limited, Bristol, England

[22] Filed: Dec. 12, 1974

[21] Appl. No.: 532,248

Related U.S. Application Data

[63] Continuation-in-part of Ser. No. 264,340, June 19, 1972, abandoned.

[30] Foreign Application Priority Data

June 19, 1971 United Kingdom ..... 28893/71
July 6, 1971 United Kingdom ..... 31517/71

[52] U.S. Cl. ..... 29/194; 75/171
[51] Int. Cl.[2] ..... B32B 15/00
[58] Field of Search ..... 75/171, 170; 148/32, 148/32.5; 29/194

[56] References Cited

UNITED STATES PATENTS 3,754,902 8/1973 Boone et al. ..... 75/171
3,754,903 8/1973 Goward et al. ..... 75/171

*Primary Examiner*—R. Dean
*Attorney, Agent, or Firm*—Stevens, Davis, Miller & Mosher

[57] ABSTRACT

A high temperature corrosion resistant nickel-base alloy, e.g. for turbine stator blades in gas turbine engines, providing a good balance between mechanical strength, oxidation resistance and compatibility between a coating and a substrate. A preferred composition of the coating alloy, which composition also provides a good balance between sulphidation and oxidation corrosion, is: aluminum 25–30%; chromium 3–14%; tantalum 7–9; yttrium 0.01–0.5%; nickel remainder. An article may be provided in which the coating is combined with a substrate of the same composition except in that the substrate has an aluminum content of 5–6%.

10 Claims, 6 Drawing Figures

COMPOSITE ARTICLES

This application is a continuation-in-part of application Ser. No. 264,340 filed June 19, 1972 now abandoned.

BACKGROUND

This invention relates to high temperature corrosion resistant alloys and articles made of such alloys.

Articles required to work in a high temperature corrosive environment are known to comprise a base structure or substrate made of a nickel-base base alloy, generally providing the necessary mechanical strength for the articles, and a coating providing protection against corrosion. The useful life of the article is normally the life of its coating as measured by the number of hours which the article can spend at a given temperature in a given environment beofore corrosive effects bring about a given degradation of the coating.

The term "high temperature" is applied to temperatures of the order of 1100°–1150° C. The term "corrosive" includes corrosion by sulphidation and oxidation. Such working conditions are encountered for example by turbine blades in gas turbine engines.

The present invention is concerned with nickel-base alloys of the kind containing chromium and aluminium, refractory metals such tungsten, tantalum and molybdenum, and a rare earth such as yttrium. These constituents are present to satisfy various operating requirements of the article. Thus chromium and aluminium provide low temperature strength while the refactory metals provide high temperature strength. All these constituents have an effect, favourable or otherwise, on coating life. Other elements may be present e.g. cobalt, titanium, zirconium, boron and niobium, as well as carbon, but these are rather less relevant to the issues of coating life.

Coating life may be considered broadly under two headings, viz., corrosion resistance and compatibility with the substrate. To ensure compatibility it is desirable for the composition of the coating to be as near as possible the same as that of the substrate except of course for those constituents by which the coating must necessarily differ from the substrate and where problems can arise from diffusion between coating and substrate. One such constituent is aluminium, and it is known to improve corrosion resistance simply by aluminum-enriching a surface layer of the article whose base structure must not be similarly rich in aluminium as this would be detrimental to mechanical strength. The aluminium-rich surface layer or coating, may be produced by diffusing aluminum into the surface of the component or by applying to the substrate a coating having the same composition as the substrate except for the aluminium content. The coating may be applied by such known methods as vacuum deposition, plasma spraying or sputtering.

The aluminium content required for resistance against oxidation corrosion may be as high as 30% whereas the base structure may be limited for reasons of mechanical strength to an aluminum content of say 6%. A certain amount of diffusion of aluminium into the substrate is therefore unavoidable but this is not generally regarded as a serious problem.

However, as far as the other constituents are concerned, there are difficulties which place serious limitations on the use of these constituents and which require careful selection thereof if the requirements of substrate compatibility, corrosion resistance, and other factors (to be described) are to be optimised in terms of component life.

SUMMARY OF INVENTION

It is an object of this invention to provide a coating alloy having a satisfactory balance between sulphidation and oxidation resistance, having good stability of coating and which, except for the content of aluminium, has a composition whose mechanical strength properties make the alloy equally suitable as a base alloy thereby ensure good compatibility betweem high and low aluminium versions of the alloy.

It is also an object of this invention to provide an article combining said high and low aluminium versions of the alloy.

According to this invention there is provided a coating alloy consisting essentially of, by weight:

| | |
|---|---|
| Aluminium | 10 to 30% |
| Chromium | 3 to less than 15% |
| Tantalum | 1.5 to 12% |
| Tungsten | 3.5 – 13.5% |
| Yttrium | 0.01 to 0.5% |
| Nickel | Balance |

Further according to this invention there is provided an article comprising a substrate consisting essentially of by weight:

| | |
|---|---|
| Chromium | 3 to less than 15% |
| Tantalum | 1.5 to 12% |
| Tungsten | 3.5 to 13.5% |
| Aluminium | 5.0 – 7.0% |
| Yttrium | 0 – 0.5% |
| Nickel | Remainder |

and the article further comprising a coating consistency essentially of by weight:

| | |
|---|---|
| Chromium | 3 to 15% |
| Tantalum | 1.5 to 12% |
| Tungsten | 3.5 to 13.5% |
| Aluminium | 10.0 to 30.0% |
| Yttrium | 0.01 to 0.5% |
| Nickel | Remainder |

wherein the contents of chromium, tantalum, tungsten and nickel occur in similar proportions in the substrate and the coating but to a lesser total amount in the coating to accommodate the higher aluminium content thereof.

CONSIDERATIONS UNDERLYING THE INVENTION

The present invention is based on certain findings now to be described.

The refractory metal molybdenum has been found to be unsatisfactory if present in the coating because it has a volatile oxidation product which is detrimental to the stability of the film of aluminum oxide which forms on the surface of the coating and which is itself the means of protection against corrosion.

Tungsten is unsatisfactory as a sole refractory metal because it makes the coating susceptible to localised penetration by oxides, but tungsten is satisfactory in the presence of tantalum.

Carbon enters into consideration in that the coating can act as a getter for carbon in the substrate. Thus the alloy should have a low carbon content to balance strength in the substrate against corrosion resistance in the coating. It is known to add small quantities of yttrium to the alloy to improve the oxidation resistance basically provided by aluminium but in cases where the tungsten content is high, say 10%, the effect of yttrium is virtually nil. However, the addition of tantalum to the tungsten enhances the beneficial effect of yttrium.

Thus it was established that coating life is sensitive to yttrium in presence of particular refractory metals only and that of these molybdenum should be excluded, tungsten cannot be used alone, tantalum can be used alone but the sole use of a single refractory is not conducive to optimum mechanical strength and that tungsten and tantalum together are effective both for mechanical strength and for oxidation resistence.

Turning now to the respective requirements of oxidation and sulphidation corrosion, it is known that chromium is helpful in reducing sulphidation. On the other hand an increase in chromium to proportions providing effective sulphidation resistance is injurious to the mechanical strength of the alloy. Thus while it might be desirable to have a high chromium content in the coating to resist sulphidation, such high content is not desirable or possible in the base structure. On the other hand it is not generally feasible to make an article having in the coating a chromium content substantially higher than in the substrate because at high temperatures, the chromium would diffuse into the substrate and create, in the aluminium-poor composition thereof, brittle phases injurious to the strength of the article and the stability of the coating. Such interface embrittlement can occur for example if the chromium contents of coating and substrate are respectively 25% and 15%.

Further, when considering oxidation and sulphidation, these two forms of corrosion occur at different temperatures. Oxidation is a problem at 1100°–1150° C whereas sulphidation is a problem at 800°–950° C.

Therefore, when designing a particular alloy regard must be had to how much time the component has to spend at the respective temperature ranges and what the sulphur content of the environment is.

In the case of the component being a turbine stator blade in a gas turbine engine wherein the normal operating temperature of the blade is in the high temperature range while only, say, idling operation is performed at the low temperature range, the optimum chromium content of the alloy may be depressed by the greater duration of high temperature exposure.

Moreover, it has now been established that while chromium improves sulphidation resistance it is detrimental to resistance against oxidation when this is taken into account the following picture emerges.

Considering mechanical properties and oxidation resistance alone, a chromium content of about 6% is desirable. Considering sulphidation alone one may go as high as 45% to find satisfactory suppression of sulphidation although considerations of interface embrittlement and mechanical strength of substrate would make such a high chromium content impossible. It has now been established that to provide adequate protection against sulphidation without undue loss of oxidation resistance, a chromium range of 9–<15% is a good optimum which will also satisfy the desirability of substantially similar chormium contents in base and coating alloys at a percentage giving adequate mechanical strength and lying clear of embrittling phases. An upper chromium limit of 14% is acceptable with chromium ranges having other lower limits of 3 and 10%. One operable range has from 11–13% chromium.

PARTICULAR DESCRIPTION

Examples of alloys and articles according to this invention will now be described in part with reference to the accompanying photomicrographs wherein.

Figure 4:
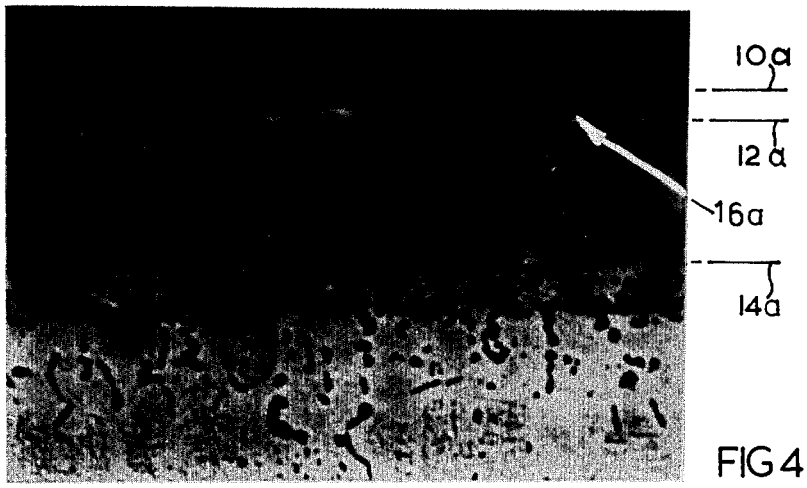
Figure 5:
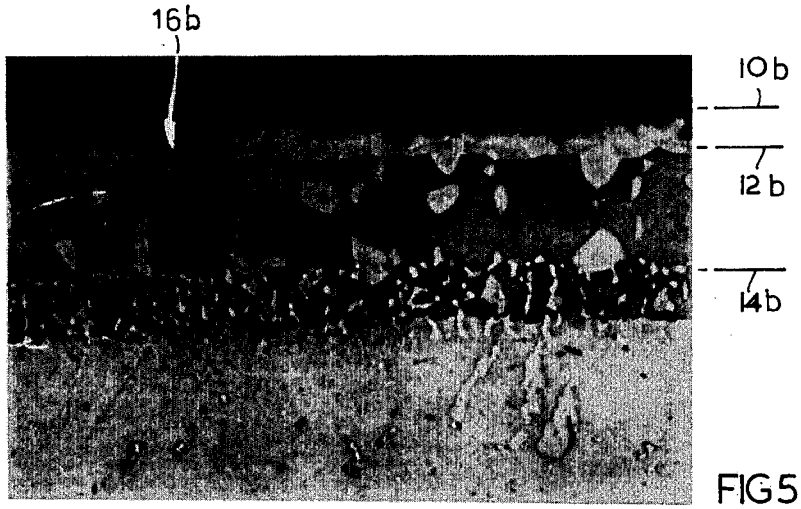
Figure 6:
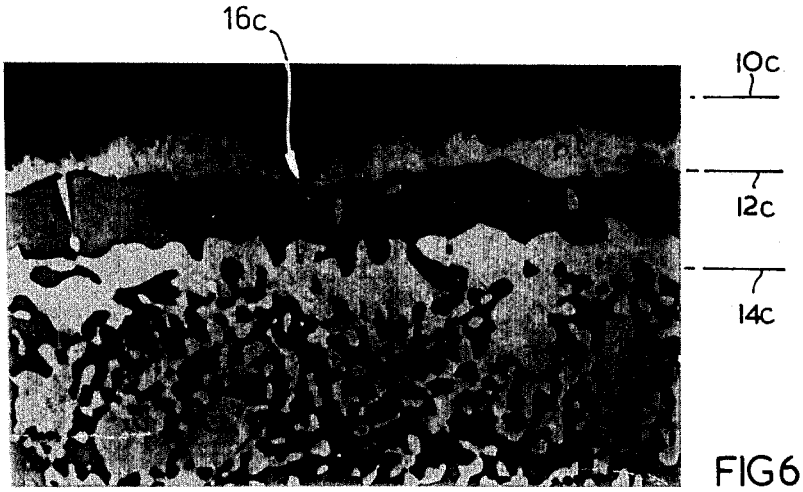

FIGS. 4, 5 and 6 is a section of a surface layer and substrate of further article made of a specific nickel base alloy containing yttrium, tungsten and tantalum and wherein the three figures illustrate, respectively, the effect of oxidation in the presence of a chromium content 6%, 15% and 25%.

EXAMPLE 1

Samples were made up of alloys having the following compositions by weight: In a first sample, code 376

| | |
|---|---|
| Boron | 0.1% |
| Carbon | 0.06% |
| Cobalt | 11.8% |
| Chromium | 5.8% |
| Aluminium | 5.7% |
| Tungsten | 8.0% |
| Tantalum | 8.0% |
| Niobium | 0.5% |
| Molybdenum | 0.5% |
| Nickel | Remainder |

A second sample, code 632, was prepared having the same composition as the first sample but with the addition of 0.05% by weight of Yttrium.

Note: the weight of Yttrium quoted in this and all following examples is the weight actually added to the melt and this will not necessarily be the same as the 'analysed' weight of Yttrium in the alloy after melting.

Both samples were placed into a furnace containing on oxidising atmosphere at 1100° C and examined at 50 hour intervals. Sample 1 was found to be oxidised to the extent of 0.005 inch surface penetration after 200 hours but sample 2 lasted for 530 hours before the same state of oxidation was reached.

EXAMPLE 2

Samples were made up having the following composition by weight: Sample 1, code 376 (with zirconium added):

| | |
|---|---|
| Boron | 0.1% |
| Carbon | 0.06% |
| Cobalt | 11.8% |
| Chromium | 5.8% |
| Aluminium | 5.7% |

-continued

| | |
|---|---|
| Tungsten | 8.0% |
| Tantalum | 8.0% |
| Niobium | 0.5% |
| Molybdenum | 0.5% |
| Zirconium | 0.1% |
| Nickel | Remainder |

Sample 2 — code 634 — as sample 1 with the addition of 0.05% by weight of Yttrium.

Sample 3 — code 635 — as sample 1 but with the Yttrium content increased to 0.1%.

Test pieces of the samples were heated for 500 hours at 1050° C, in an oxidising atmosphere and the resulting oxide penetration of the surface and measured and the results were as follows:

| Sample | Maximum Surface Penetration in Microns |
|---|---|
| 1 | 80 m |
| 2 | 70 m |
| 3 | 55 m |

It is clear on the basis of the above examples that the corrosion resistance increases as the amount of Yttrium increases.

It is known that chromium improves corrosion resistance although in relatively large quantities it can have a deleterious effect on impact resistance. Where corrosion resistance is the most important property required in the alloy however, the chromium content may be increased up to 15% and the remaining ingredients re-balanced to provide optimum impact resistance at the expense of some rupture strength.

Although preferably titanium is not used due to the possibility of a reaction between the titanium and tantalum, titanium-containing alloys can benefit from the invention provided the tantalum content is kept near the minimum and the titanium content does not exceed 5%.

The following examples show how the addition of Yttrium affects the life of a diffused aluminum coating applied to the base alloy and in particular the improvement when tantalum is also present.

EXAMPLE 3

Four samples were made of an alloy, code 626, having the following composition by weight:

| | |
|---|---|
| Boron | 0.01% |
| Carbon | 0.06% |
| Cobalt | 11.8% |
| Chromium | 5.8% |
| Aluminium | 5.7% |
| Tungsten | 8.0% |
| Molybdenum | 0.5% |
| Niobium | 0.5% |
| Tantalum | 8.0% |
| Nickel | Remainder |

and to each of three of the samples was added respectively 0.025%, 0.050% and 0.100% by weight of Yttrium, the fourth sample being left free of Yttrium.

All four samples were then provided with a diffused aluminium coating by a method known as "packing aluminising" in which the samples were heated in a sealed vessel in contact with a pack containing, for example, 10% to 30% by weight of Aluminium powder 0.1% to 1% by weight of Ammonium Bromide and the remainder, a granular refractory material which is inert as far as the process reaction is concerned. Such a process is described and claimed in U.K. Pat. No. 1,003,222. The reaction was allowed to continue for a sufficient time to produce a coating of the desired thickness, which for the purpose of the present invention was 0.0025 ins. to 0.0030 ins.

The following results were obtained after heating the four samples in an oxidising atmosphere for 1000 hours at 1050° C, and measuring the resulting oxide penetration.

| Sample | Yttrium content | Maximum Oxide Penetration |
|---|---|---|
| 4 | 0% | 0.010 ins |
| 1 | 0.025% | 0.0045 ins |
| 2 | 0.05% | 0.0007 ins |
| 3 | 0.1% | 0.0002 ins |

It is clear on the basis of this example that the addition of Yttrium to the base alloy improves the life of a subsequent diffused coating, and that the improvement increases as the amount of Yttrium increases.

EXAMPLE 4

To illustrate the effects of a combination of tantalum and Yttrium on the coating life the following samples were made up.

The first sample was an alloy sold under the trade name of PD 16 and having the following composition by weight:

| | |
|---|---|
| Boron | 0.02% |
| Carbon | 0.12% |
| Cobalt | 1.0% |
| Chromium | 6.0% |
| Aluminium | 6.0% |
| Tungsten | 11.0% |
| Molybdenum | 2.0% |
| Niobium | 1.5% |
| Zirconium | 0.13% |
| Titanium | 0.2% |
| Nickel | Remainder |

The second sample was as the first with the addition of 0.05% Yttrium, and the third sample was as sample 2 with the further addition of 4.0% of tantalum.

Each of the samples was "pack-aluminised" to provide a diffused aluminum coating to approximately 0.0025 ins. depth and then the three samples were heated for 1000 hours in an oxidising atmosphere at a temperature of 1150° C.

Figure 1:
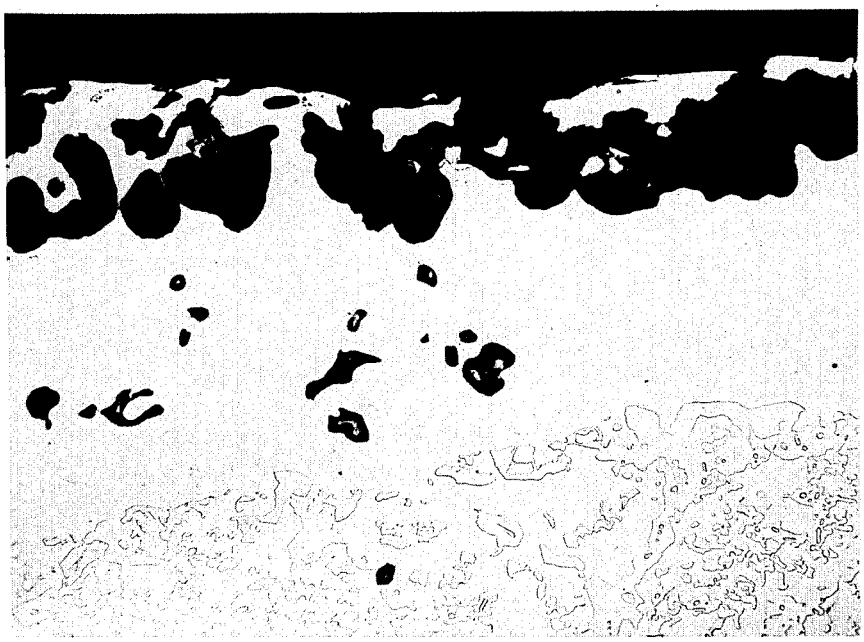
FIG. 1 is a section of a surface layer and substrate of an article made of a specific nickel-base alloy having tungsten as a sole significant refractory, and shows the effects of oxidation corrosion.
Figure 2:
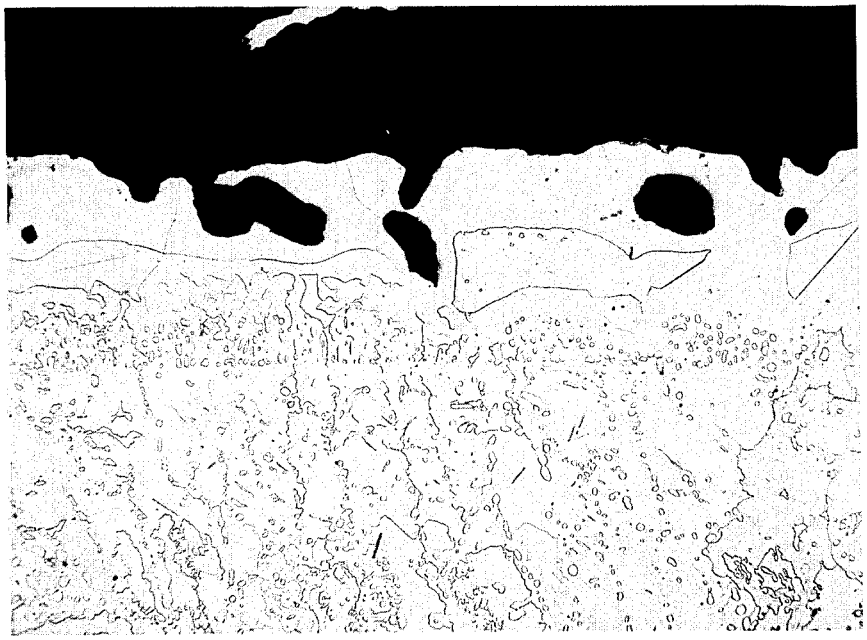
FIG. 2 is a section similar to FIG. 1 but showing the effect of oxidation corrosion if yttrium is added to the alloy illustrated in FIG. 1.
Figure 3:
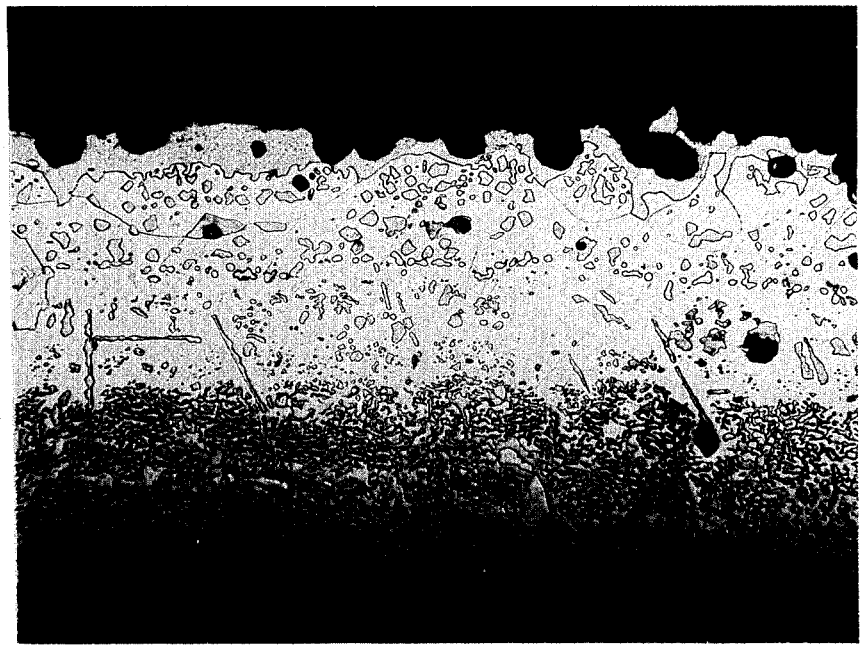
FIG. 3 is a section similar to FIG. 2 but showing the effect of oxidation corrosion if tantalum is added to the alloy illustrated in FIG. 2.

FIGS. 1, 2 and 3 show the surface region of each PD. 16-based sample after cutting and polishing, the blackened areas showing oxide penetration. Although the aluminised coatings have been clearly destroyed in each case, it is also clear that the PD 16 alloy alone had the shortest life because the penetration of oxide is by far the greatest (FIG. 1). The coating on the alloy PD 16 with Yttrium survived longer since the oxide penetration was somewhat less, (FIG. 2) showing that the Yttrium had a beneficial effect, but the coating on the alloy PD 16 with both Yttrium and tantalum had the least penetration by the oxide (FIG. 3).

In all the above examples the coating was created by the diffusion of aluminium. Yttrium is not amenable to diffusion and was introduced into the alloy directly, i.e. into the melt, although it is not required in the substrate. If the article is made by surface deposition of a coating, e.g. by plasma spraying, then the yttrium need of course be present only in the coating alloy to be deposed. In other words the yttrium content of the substrate may be between zero and that required for the coating.

Two factors limit the amount of yttrium used for practical purposes however, and these are the cost of yttrium and the effect of the yttrium on the desirable properties of the alloy. For gas turbine engine application, high impact resistance and stress rupture life are important and both of these properties are reduced with the addition of yttrium, to the extent that with yttrium contents higher than 0.2% the alloys are not acceptable for gas turbine work. For other applications, however, greater quantities of yttrium may be used but it is expected that the gains in oxidation resistance beyond 0.5% of yttrium would be offset by the cost of yttrium to an extent which would make further addition of yttrium uneconomic.

The improvement in oxidation resistance in a coating containing yttrium and vantalum is of particular benefit in alloys for articles which work under stress in an environment where the addition of too much chromium would be injurious to the strength of the alloy, especially in casting alloys sensitive to a good balance of the different aspects of mechanical strength, e.g. an alloy as described in our United Kingdom Pat. No. 1,011,785.

In the above described examples the chromium content of the alloys was 5.8 or 6.0%. Generally it has been found that, chromium may vary between 3 and less than 15%. An upper chromium limit of 14% is acceptable with chromium ranges having other lower limits of 6, 9 and 10%. One operable range has from 11–13% chromium. Up to 9% chromium is beneficial if sulphidation is not a problem; otherwise up to less than 15% is desirable. From 15% onward there is loss of oxidation resistance and breakdown of compatibility between the coating and the necessarily low chromium substrate.

Experiments have been made to establish the importance of chromium in the coating both in respect of oxidation resistance and compatibility with the substrate. It has already been mentioned that chromium has a dilatirious effect on impact resistance but that up to less than 15% chromium may be used if this is desirable for the sake of sulphidation resistance. It is known that a further increase in chromium content progressively improves the resistance against sulphidation corrosion but progressively enhances the tendency of the chromium to form brittle phases in the alloy. This tendency is reduced in the presence of high aluminium content such as is found in the coating (as distinct from the substrate) and for this reason a high chromium content is tolerable in the coating from the embrittlement point of view. But a high chromium content in the coating, say 20 to 25% as against 15% chromium in the substrate, leads to diffusion, at high temperature, of chromium into the low aluminium substrate there to create brittle phases, and this demanded that the chromium content of the coating should not significantly exceed that of the substrate.

However, quite apart from such interface embrittlement it was found that while increasing the chromium content of the coating improved sulphidation resistance, the same could not be said of oxidation resistance.

The following is a description of an example made of the effect of chromium on oxidation resistance at high temperatures.

EXAMPLE 5

Three samples were prepared of alloys similar to alloy 632 (mentioned in connection with example 1) and now referred to as alloys 632*a*, 632*b*, and 632*c*. The composition of alloy 632*a* was virtually the same as that of said alloy 632, namely:

| | | | |
|---|---|---|---|
| Boron | 0.1% | Tantalum | 8.0% |
| Carbon | 0.06% | Niobium | 0.5% |
| Cobalt | 11.8% | Molybdenum | 0.5% |
| Chromium | 6.0% | Yttrium | 0.05% |
| Aluminium | 5.7% | Nickel | Balance |
| Tungsten | 8.0% | | |

Alloys 632*b* and 632*c* had the same constituents as alloy 632*a* except in that alloy 632*b* had 13% chromium with a corresponding proportionate reduction in the percentages of the other constituents, and alloy 632*c* had 25% chromium with a corresponding proportionate reduction in the percentage of the other constituents.

The samples were aluminised by surface diffusion to raise the aluminum content to approximately 30% and to a depth of 0.002 inch (50 micron). The samples were then exposed to an oxidising atmosphere at 1150° C and cycled to room temperature every 25 hours. After 500 hours the weight of scale spalled off the surface of the specimens was weighed and the specimens were sectioned and metallurgically examined with the following results:

| Alloy | 632a | 632b | 632c |
|---|---|---|---|
| Chromium content % | 6 | 13 | 25 |
| Weight of oxide spalling mg/cm² | 2.5 | 7.0 | 8.4 |
| Depth of oxide penetration; in microns | 20 | 30 | 60 |

The metallurgical section are shown in FIGS. 4, 5 and 6 which are photo-micrographs of alloys 632*a*, 632*b* and 632*c* respectively. In FIGS. 4, 5 and 6, respectively, lines 10*a*, 10*b* and 10*c* indicate the position of the original surface of the specimen, lines 12*a*, 12*b* and 12*c*, indicate the greatest depth of oxide penetration, and lines 14*a*, 14*b* and 14*c* indicate the position of the interface between the aluminum-rich surface layer and the substrate. Also, in FIGS. 4, 5 and 6, respectively, arrows 16*a*, 16*b*, 16*c* show the point of deepest oxide penetration.

These tests indicate that as the chromium content increases the beneficial effects of tantalum and yttrium, i.e. reducing oxide spall and prolonging coating life, are lost. This is due to the protective alumina scales present in the low chromium samples being replaced by chromium oxide spinels.

As shown by arrow **16*b*** the 15% chromium alloy is beginning to show significant oxide penetration and for this reason 15% chromium is regarded as the lower limit of chromium contents unsuitable for present purposes.

As mentioned, oxidation corrosion must be considered together with sulphidation corrosion so that neither form of corrosion shall dominate coating life. In the context of the sulphidation encountered in gas turbine engines it has been found that a chromium content of 9 to <15% is satisfactory in providing a good balance between the two forms of corrosion. If the chromium content is increased to or beyond 15% is satisfactory in providing a good balance between the two forms of corrosion. If the chromium content is increased to or beyond 15% then coating life is limited by oxidation and if the chromium content is reduced below 9% coating life is limited by sulphidation.

EXAMPLE 6

An alloy, denoted 1088, which has been found to provide a good balance between oxidation and sulphidation resistance has the following composition (by weight):

| | |
|---|---|
| Boron | 0.025% |
| Carbon | 0.1% |
| Cobalt | 12.0% |
| Chromium | 12.0% |
| Aluminium | 5.2% |
| Tungsten | 8.5% |
| Tantalum | 8.0% |
| Zirconium | 0.1% |
| Yttrium | 0.025% |
| Nickel | Remainder |

The corresponding coating composition diffentionly in that the aluminium content is 25–30% with a proportionate reduction in the percentage of the other constituents.

The following is a comparison of tests made with three base alloys, viz. PD 16, 532*a* and 1088.

| Type of Test | Result on Alloy:- PD16 | 632a | 1088 |
|---|---|---|---|
| Bend creep temperature for 1% creep in 100 hours at 7 tons/squ. inch. | 1080° C | 1105° C | 1100° C |
| Cycles to failure in thermal shock at 1100° C to room temperature. | 2000 | 2000 | 2500 |
| Impact resistance at 900° C in ft. lbs. | 25 | | 45 |
| Combustion chamber corrosion test (with 4 ppm salt) at 870° C. Depth of attack in 120 hours; in microns. | 550 | 450 | 50 |

The main object of this test was to establish sulphidation corrosion data alongside certain basic mechanical properties. This complements the oxidation corrosion data given in example 5 with alloy 632*a* and 632*b*. It will be noted that alloys 632*a* and 1088 are not significantly different except for chromium which is 12% in alloy 1088. The 15% chromium of alloy 632*b* was considered too high from the oxidation point of view. Alloy 632*a* (6% chromium) is shown by the present test to have a rather low sulphidation resistance. By taking the chromium content to 12% in alloy 1088 the sulphidation resistance is dramatically improved from 450 to 50 microns while the oxidation resistance is kept away from the beginnings of undue oxidation wear shown at 15% chromium in Example 5 (FIG. 5). At the same time the mechanical properties are all improved as compared to alloys 632 and PD16. The latter was used in the test as a check.

In Example 5 the oxidation test was made with the coating composition (30% initial aluminium) while in Example 6 the sulphidation test was made with the base alloy. The reason for this has to do with the mechanism of coating wear which may be explained as follows.

During the test, as during actual use, the aluminium of the coating unavoidably diffuese into the substrate. In other words the aluminium-rich layer tends to become thicker and less aluminium-rich. At the same time there is corrosion penetration of the coating surface. As the aluminium content is reduced by diffusion so the resistance to corrosion penetration decreases. Eventually corrosion penetrates to the substrate.

Since, in the context of blades for gas turbine engines, the article spends more time at high temperatures (where oxidation is the dominant corrosion) than at low temperatures (where sulphidation is dominant), the initial wear is likely to be due to oxidation. Therefore the initial composition of the coating has to be orientated towards oxidation resistance, i.e. has to have a low chromium content alongside the highest possible aluminium content.

At this stage sulphidation is of secondary significance not only because of the high temperature but also by reason of the high aluminium concentration. But as the aluminium concentration declines due to diffusion the low chromium content becomes increasingly significant and sulphidation tends to dominate.

For these reasons oxidation is usually measured as from the freshly coated condition of the article whereas sulphidation is measured at low aluminium (say 10–15%) or, for simplicity, at base metal compositions (6% aluminium). The chromium content of the alloy is of course a compromise between the initial dependence of the alloy on a low chromium content and the later dependence on a high chromium content.

EXAMPLE 7

To confirm the unique properties of tantalum, tests were made with alloys similar to alloy 632 but having refractory metals other than the combined tantalum and tungsten of alloy 632. To determine the effect of tungsten as sole refractory, alloy PD16, mentioned in connection with Example 4, was taken because, compared to alloy 632, it has no tantalum but has a high tungsten content (11.0%) and non-significat contents of molybdenum (2.0%) and cobalt (1.0%). The chromium content of PD16 is normally 6%. The specimens prepared for the test had the same yttrium content (0.05%) as alloy 632a and were aluminised and tested as described in Example 5. At the end of 500 hours the coating showed about 60% oxide penetration of the coating, thus showing that tungsten as the sole refractory does not improve oxidation resistance.

A specimen of alloy PD 16 constituted as described in this example but having 15% chromium was tested and showed dramatic right-through penetration of the coating, thus showing a particularly bad effect with increasing chromium.

EXAMPLE 8

To determine the effect of molybdenum as a refractory metal, a test similar to that described in Example 5 was made with an alloy denoted C1023 including yttrium which has the following composition.

| | |
|---|---|
| Carbon | 1.5% |
| Chromium | 15% |
| Cobalt | 10% |
| Aluminium | 4% |
| Titanium | 3.5% |
| Molybdenum | 8.5% |
| Yttrium | 0.05% |
| Nickel | Remainder |

Here again a complete oxide penetration of coating was found, thus showing that a high level of molybdenum is deleterious as a sole refractory metal.

Examples 5 to 8 show that of the three refractory metals tantalum, tungsten and molybdenum, the sole of tungsten or molybdenum deprives the alloy of the beneficial effects of yttrium, at least where these refractories are of the order of 10% in combination with chromium of the order of 15%.

It is reasonable to assume that the position is the same with chromium contents of less than 15%. At least Example 7 shows that the maleficial effect of tungsten as sole refractory is present at 6% chromium. On the other hand, the beneficial effect of tantalum and tungsten combined are present down to 5,8% chromium as shown by Example 1.

Cobalt, present in some of the examples, has not been found to be significant as far as oxidation resistance in this general type of alloy is concerned but it is introduced in proportions of the order of 10% for purposes of structural stability.

Carbon is desirably limited to 0.03 to 0.1% in the alloys described to avoid absorption of carbon into the coating with some loss of corrosion resistance due to combination of carbon and chromium and consequent reduction in the chromium in solid solution available for corrosion resistance. On the other hand this must be balanced against too low a carbon content causing loss of mechanical strength in the substrate. The range quoted has been found to be an acceptable compromise.

We claim:

1. An article for use in a high temperature corrosive environment comprising a substrate consisting essentially of, by weight:

| | |
|---|---|
| Aluminium | 5 to 7% |
| Chromium | 3 to 14% |

-continued

| | |
|---|---|
| Tantalum | 1.5 to 12% |
| Tungsten | 3.5 to 13.5% |
| Yttrium | 0 to 0.5% |
| Nickel | Remainder |

and the article further comprising a coating consisting essentially of, by weight:

| | |
|---|---|
| Aluminium | 10 to 30% |
| Chromium | 3 to 14% |
| Tantalum | 1.5 to 12% |
| Tungsten | 3.5 to 13.5% |
| Yttrium | 0.01 to 0.5% |
| Nickel | Remainder |

wherein the contents of chromium, tantalum, tungsten and nickel occur in similar proportions in the substrate and the coating but to a lesser total amount in the coating to accommodate the higher aluminium content thereof.

2. An article according to claim 1 wherein the chromium content in the substrate and the coating is 6 to 14%.

3. An article according to claim 1 wherein the chromium content in the substrate and in the coating is 9 to 14%.

4. An article according to claim 1 wherein the chromium content in the substrate and in the coating is 10 to 14%.

5. An article according to claim 1 wherein the chromium content in the substrate and in the coating is 11–13%.

6. An article for use in a high temperature corrosive environments comprising a substrate consisting essentially of, by weight:

| | |
|---|---|
| Aluminium | 5 to 6% |
| Chromium | 11 to 13% |
| Tantalum | 7 to 9% |
| Tungsten | 7 to 9% |
| Yttrium | 0 to 0.5% |
| Nickel | Remainder |

and the article further comprising a coating consisting essentially of, by weight:

| | |
|---|---|
| Aluminium | 25–30% |
| Chromium | 11 to 13% |
| Tantalum | 7 to 9% |
| Tungsten | 7 to 9% |
| Yttrium | 0.01 to 0.5 |
| Nickel | Remainder |

wherein the contents of chromium, tantalum, tungsten and nickel occur in similar proportions in the substrate and the coating but to a lesser total amount in the coating to accommodate the higher aluminium content thereof.

7. An article according to claim 1 wherein the yttrium content of the substrate is 0 to 0.2%.

8. An article according to claim 6 wherein the yttrium content of the substrate is 0 to 0.2%.

9. An article according to claim 1 wherein the substrate and the coating each include a carbon content of 0.03 to 0.1%.

10. An article according to claim 6 wherein the substrate and the coating each include a carbon content of 0.03 to 0.1%.

* * * * *